US005899052A

United States Patent [19]

Turner

[11] Patent Number: 5,899,052

[45] Date of Patent: May 4, 1999

[54] HIGH HARDNESS BORON STEEL ROTARY BLADE

[75] Inventor: Darrel L. Turner, Reeseville, Wis.

[73] Assignee: Fisher-Barton, Inc., Watertown, Wis.

[21] Appl. No.: 08/899,198

[22] Filed: Jul. 23, 1997

Related U.S. Application Data

[62] Division of application No. 08/532,046, Sep. 21, 1995.

[51] Int. Cl.[6] ..... A01D 34/82

[52] U.S. Cl. ..... 56/255; 56/295; 56/DIG. 17; 29/557

[58] Field of Search ..... 56/255, 295, 17.5, 56/DIG. 17, DIG. 20; 29/557

[56] References Cited

U.S. PATENT DOCUMENTS

| | | | |
|---|---|---|---|
| 1,399,044 | 12/1921 | Bellis . | |
| 3,769,784 | 11/1973 | Jones | 56/295 |
| 3,911,579 | 10/1975 | Lane et al. | 30/346.54 |
| 3,975,891 | 8/1976 | Gunther | 56/295 |
| 3,988,955 | 11/1976 | Engel et al. | 83/661 |
| 4,052,230 | 10/1977 | Aylward | 148/2 |
| 4,119,004 | 10/1978 | Ludwig | 83/661 |
| 4,399,611 | 8/1983 | Maringer | 30/350 |
| 4,919,773 | 4/1990 | Naik | 204/38.4 |
| 5,032,243 | 7/1991 | Bache et al. | 204/192.34 |
| 5,062,259 | 11/1991 | Lipscombe | 56/255 |
| 5,093,975 | 3/1992 | Masters et al. | 29/400.1 |
| 5,097,727 | 3/1992 | Fischer et al. | 76/115 |
| 5,139,006 | 8/1992 | Trudeau | 125/12 |
| 5,139,581 | 8/1992 | Grimm et al. | 148/632 |
| 5,171,109 | 12/1992 | Arai et al. | 407/46 |
| 5,251,514 | 10/1993 | Rhodarmer et al. | 76/104.1 |
| 5,299,414 | 4/1994 | Long | 56/17.4 |
| 5,456,735 | 10/1995 | Ellison-Hayashi et al. | 51/307 |

OTHER PUBLICATIONS

"New Holland Disc Mowers/Sicklebar Mowers," Ford New Holland, Inc., (Date Unknown).

"International Standard ISO 5718–1, Harvesting equipment—Flat blades for rotary mowers—Specifications—Part 1: Type vbvbA flat blades," International Organization for Standardization, Switzerland, (Date unknown).

"Metallurgy for Non–metallurgists," Fisher Barton Inc., Watertown, WI (Date Unknown).

"Mower Blades," Fisher Barton Inc., Watertown, WI ( Date Unknown).

"Impact Toughness of Mower Blades," Darrel L. Turner, Fisher Barton, Inc., (Date unknown).

"Austempering Heat Treatment," Fisher Barton, Inc., Watertown, WI (Date Unknown).

"Material Standards for OEM Mower Blades," Fisher Barton, Inc., Watertown, (Date Unknown).

"Mower Blade Quality—Bend Testing," Fisher Barton, Inc., Watertown, WI (Date Unknown).

"Discussion of Fatigue Resistance in Mower Blade Materials" Fisher Barton Inc. (Date unknown).

*Primary Examiner*—Terry Lee Melius

*Attorney, Agent, or Firm*—Lathrop & Clark LLP

[57] ABSTRACT

A rotary blade for a mower or cutter is formed from boron steel, such as 10B38 steel, and is heat treated to yield high hardnesses of 48 Rockwell C or above. The blade has increased hardness because of the heat treating, but due to the alloy composition, is still sufficiently tough to perform satisfactorily as a cutting blade, in particular to pass conventional impact tests. Furthermore, the low carbon content of the blade makes cold working of the part practical.

3 Claims, 3 Drawing Sheets

HIGH HARDNESS BORON STEEL ROTARY BLADE

This application is a division of application Ser. No. 08/532,046, filed, Sep. 21, 1995, (currently pending).

FIELD OF THE INVENTION

The present invention relates to cutting blades in general, and to rotary mower and cutter blades which must resist impact loads in particular.

BACKGROUND OF THE INVENTION

Safety and durability are of primary concern in the production of lawn mower blades, agricultural and off-highway rotary cutter blades. Experience with blade failures in the field has driven manufacturers to produce blades with low hardness to prevent catastrophic impact failure and related safety concerns. A reduction in blade hardness will tend to reduce the incidence of brittle failures, but it will also reduce yield strength and increase failures from bending, fatigue and wear.

Rotary cutter blade standards have been developed to provide desired levels of blade performance and safety. An industry standard of relevance to rotary cutter blades is the "Blade Impact Test" of ASAE S474, Agricultural Rotary Mower Safety. This test drops a mower with blades rotating onto a two-inch diameter steel stake. No part of the mower or mower component can fail in a way hazardous to anyone in the area. This test will determine the weak link, if any, in the machine and impacts the blade in a worst case manner.

Despite industry standards, rotary cutter blades may still fail, even when those blades satisfy standards with respect to material grade, heat treat process, and hardness and bend tests for ductility. Failures due to wear and bending beyond a usable shape are the most common. These failures are often the result of specifications which tend toward low blade hardness and high ductility at the sacrifice of yield strength and wear resistance. These type of failures cause inconvenience and expense. Fatigue failures can be reduced by blade design and by increased hardness. Increased hardness will also reduce failures due to bending and wear. Mitigating the benefits of increased hardness in conventional blades, is the tendency of the higher hardness material to suffer unacceptable catastrophic impact failure.

High carbon steels exhibit desirable higher levels of hardness, but present several drawbacks in rotary blade applications, such as in a mower or cutter. High carbon steels are difficult to work, and cause accelerated tool wear, adding to manufacturing costs. Furthermore, the higher hardness of the high carbon steels is coupled with reduced toughness. In addition, higher carbon and alloy content steel is more costly, and the annealing required adds further costs to the finished blade.

Boron steels, such as 10B38, have been used for lawn mower blades in lawn mowers. Boron steels exhibit desirable high levels of toughness, but in prior art mower blades, have been susceptible to wear at a greater than optimum rate. These blades also have less than optimal resistance to edge deformation, bending, and fatigue, and do not perform as well in these respects as traditional higher carbon and alloyed steels.

Although the cost for a mower blade is small compared to the equipment cost, replacement of blades is a time-consuming operation. Hence the time between blade replacements is best extended as much as possible.

What is needed is a rotary cutting blade which presents high hardness to increase wear life, while at the same time exhibiting acceptable toughness levels to insure satisfactory operation and passage of standard blade impact tests.

SUMMARY OF THE INVENTION

The rotary blade of this invention has elevated levels of toughness and hardness, achieved by heat treating a boron steel blank. The hardness of the boron steel is elevated by a marquenching or other suitable quench heat treatment to somewhere between 48 and 55 on the Rockwell Hardness Scale per ASTM E-18. If necessary, stress relief with heat may be applied. This high hardness reduces the is toughness of the material somewhat. However, because of the iron carbide morphology and distribution, once treated it is still at an acceptable level of toughness. The blade thus exhibits increased wear life due to its hardness, while offering salutary impact resistance and safety due to its high toughness.

It is an object of the present invention to provide a rotary blade which has hardness levels of between 48 and 55 on the Rockwell Hardness Scale.

It is an additional object of the present invention to provide a mower blade which exhibits high resistance to wear while at the same time being resistant to breakage.

It is a further object of the present invention to provide a cutter blade which may be cold worked.

Further objects, features and advantages of the invention will be apparent from the following detailed description when taken in conjunction with the accompanying drawings.

DESCRIPTION OF THE PREFERRED EMBODIMENT

Figure 1:
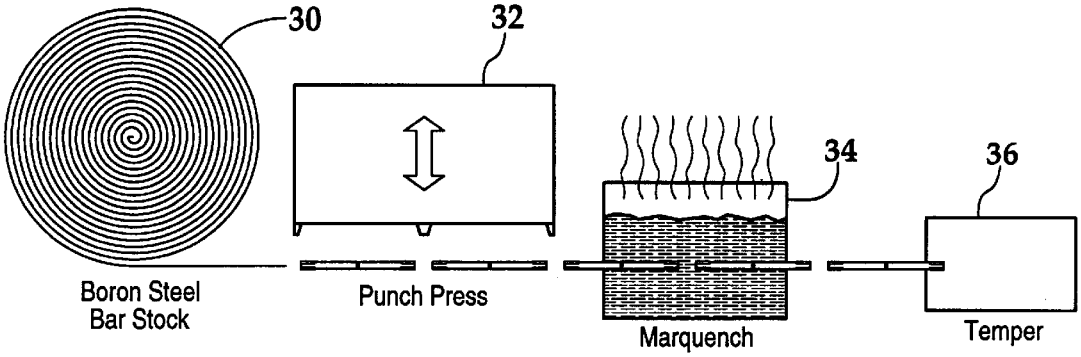
FIG. 1 is a schematic view of the process for manufacturing the rotary cutting blade of this invention.
Figure 2:
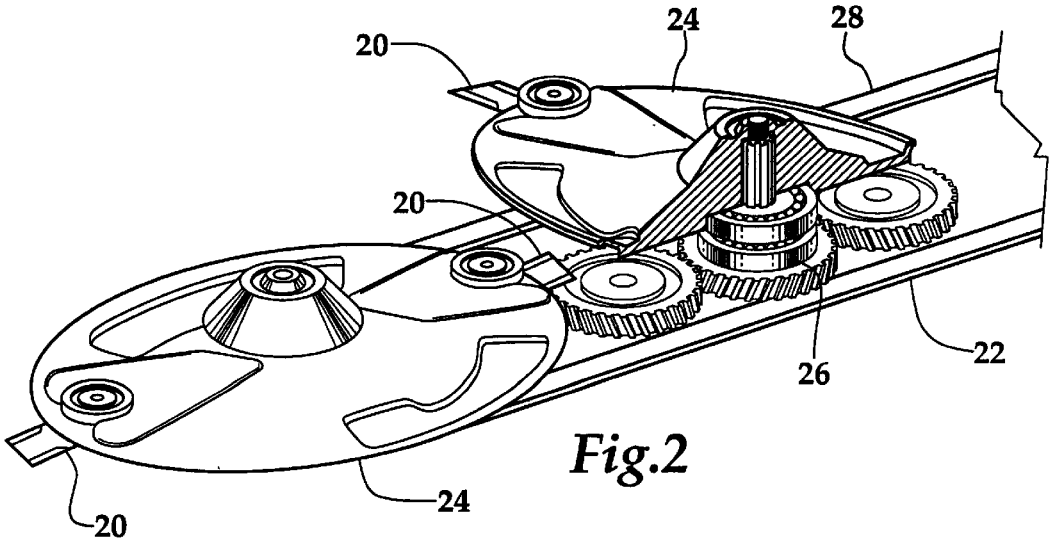
FIG. 2 is an isometric view of an exemplary blade produced according to the process of FIG. 1.
Figure 3:
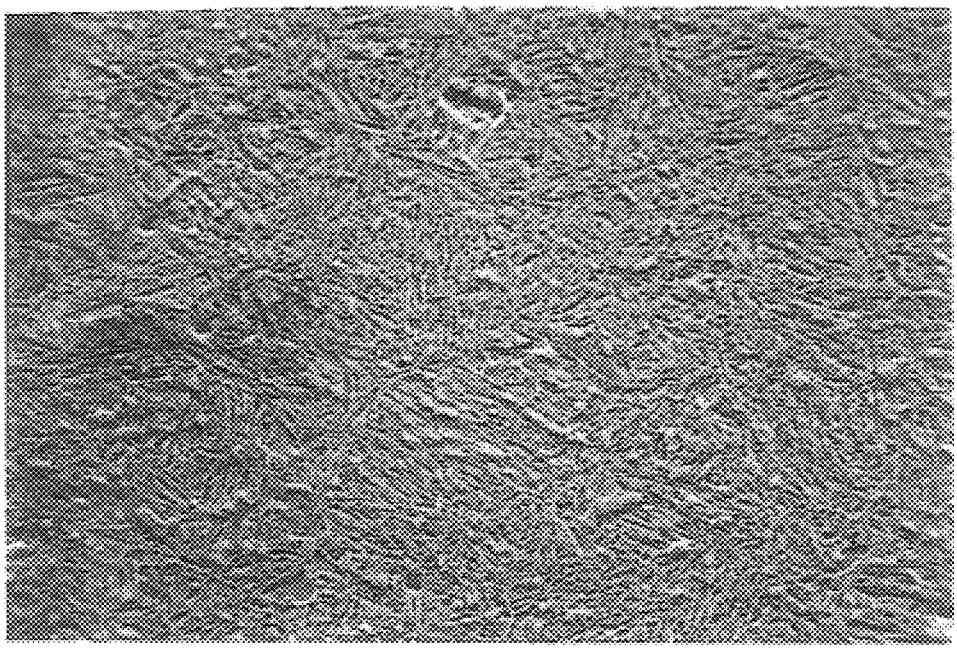
FIG. 3 is a Scanning Electron Microscopy (SEM Mag. 1000X photograph of a prior art material AISI 9255 46 Rockwell C Hardness.

Referring more particularly to FIGS. 1–6, wherein like numbers refer to similar parts, the process for producing rotary blades 20 such as for a mower is shown schematically in FIG. 1. A fragment of an exemplary disc mower 22 is shown in FIG. 2. Disc mowers are used to harvest grass crops, and employ multiple blades 20 which are fastened to rotating discs 24 which are driven in unison by a gear train 26 mounted to the mower bar 28. In many instances, the mower blades are positioned very close to the ground, to achieve maximum crop harvest, and thus are susceptible to impact with loose rocks, uneven ground, ant hills and the like. Because the blades 20 can be spun at rates of 3,000 rpm and higher, the blades are susceptible to wear by impact with ground and rocks, and also by particle erosion from pick-up of sand and loose soil particles.

The blades 20 in a mowing apparatus represent a proportionately small portion of the entire equipment cost. Nonetheless, it is desirable to increase the interval between blade replacements required due to wear, as blade replacement is a time-consuming operation during which the machine is out of service.

There are two properties which are of chief concern in rotary cutter blade function: hardness and toughness. Hardness is measured on the Rockwell C Hardness Scale, and is a good measure of the materials resistance to wear. Toughness can be measured by the Charpy Notched Impact Toughness Test per ASTM E23, and is a good indication of how the material will react to impact, in particular giving a reading on the material's tendency to fracture or crack.

Conventional blade materials have typically relied on increased proportions of carbon in the steel to increase the hardness. However, increased hardness due to increased quantities of carbon in carbon steel will yield a reduced toughness which may cause a blade made of the material to fail the blade impact test, and, more importantly, may cause a failure of the blade in use. Typical toughness of prior art carbon steel blades is 8–16 ft. lbs of energy at 40–45 Rc.

Salutary toughness performance has been obtained by the use of steel alloys containing quantities of boron, referred to herein as "boron steels." Conventional boron steels such as 10B38 have been used with a hardness which is less than desired, typically in the range of 40–45 Rockwell C. Charpy notched toughness at this hardness is about 20–30 ft. lbs. of energy.

The rotary cutter blade 20 of this invention is imparted with both high hardness and acceptable toughness by heat treating boron steel blanks to cause a metallurgical change in the blade structure. The treated blade has a hardness ranging between 48 and 55 inclusive on the Rockwell Hardness Scale and Charpy notch toughness of 15 ft. lb. or higher.

The manufacture of the blade 20 begins with a roll of boron steel sheet stock 30. The sheet stock is approximately the width of the final blade, and is a steel containing a quantity of boron, selected from the steels having the standard designations 10B36, 10B37, 10B38, 10B39, 10B40, 10B41, and 10B42, with 10B38 being employed in the preferred embodiment. It should be noted that steel alloys having concentrations intermediate between the standard levels noted may also be used.

The moderate levels of carbon present in the boron steels employed allows the boron steel sheet stock to be formed into the desired blade shape in any conventional manner, but a preferred method, but a preferred method takes advantage of the ductility of the sheet stock 30 by cold forming the blade without heating.

The sheet stock 30 proceeds from the roll to a stamping press 32, where it is made into a desired shape between dies. A progression of stations may punch holes, trim to a desired shape and length, shear or coin the cutting edges and form the blade into final or near final configuration.

The final edge may be put on the blank in another station of the press, where shear beveling is used to sheer away the material to form an inclined, beveled edge. The relatively low carbon content of the boron steels used provides for advantageous shear bevelling. High carbon steels are not well-suited to sheer bevelling because of the tendency of the high carbon steel to rapidly degrade the tool. The boron steel is also more machinable than high carbon steels and may be machined to produce edges or other features in separate operations.

The formed and edged blade proceeds from the stamping press 32 to a heat treatment station 34, where the blades are subjected to a heat treating process to elevate the hardness of the blade into a desired range of between 48 and 55 Rockwell C. In one advantageous heat treating process, known as Marquenching, the formed blades are first heated to approximately 1560° F. The heated blades are then quenched into a liquid salt bath at approximately 500° F. for about 20 seconds. The quenched blades are then withdrawn from the salt bath and allowed to air cool to room temperature. The cooled blades then proceed to a tempering station 36 where they are tempered at 300° F. as a stress relief.

Figure 5:
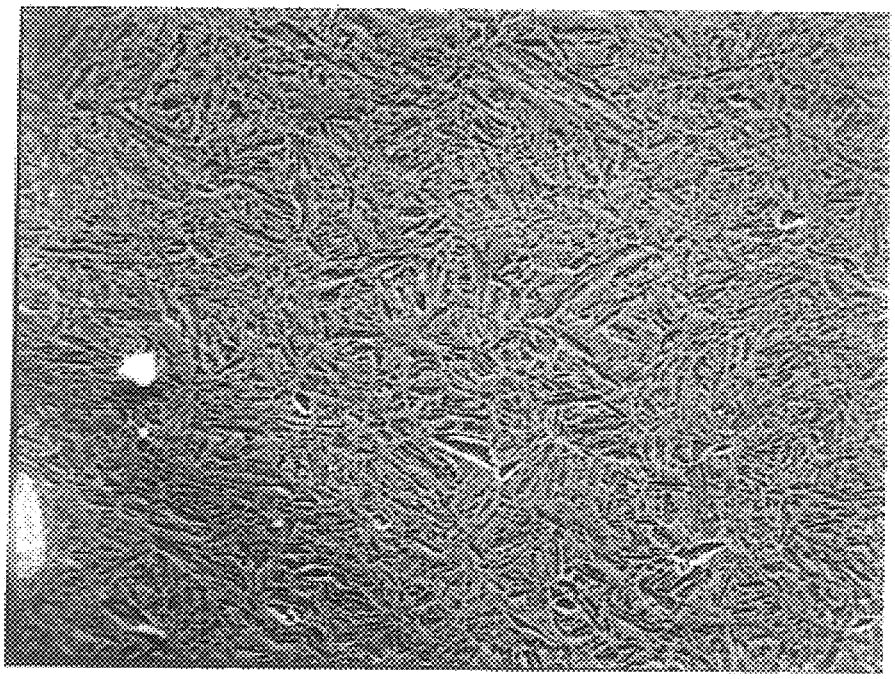
FIG. 5 is a Scanning Electron Microscopy Mag. 1000X photograph of a sample of the blade material AISI 10B38 of this invention hardened at 50 Rockwell C Hardness.
Figure 6:
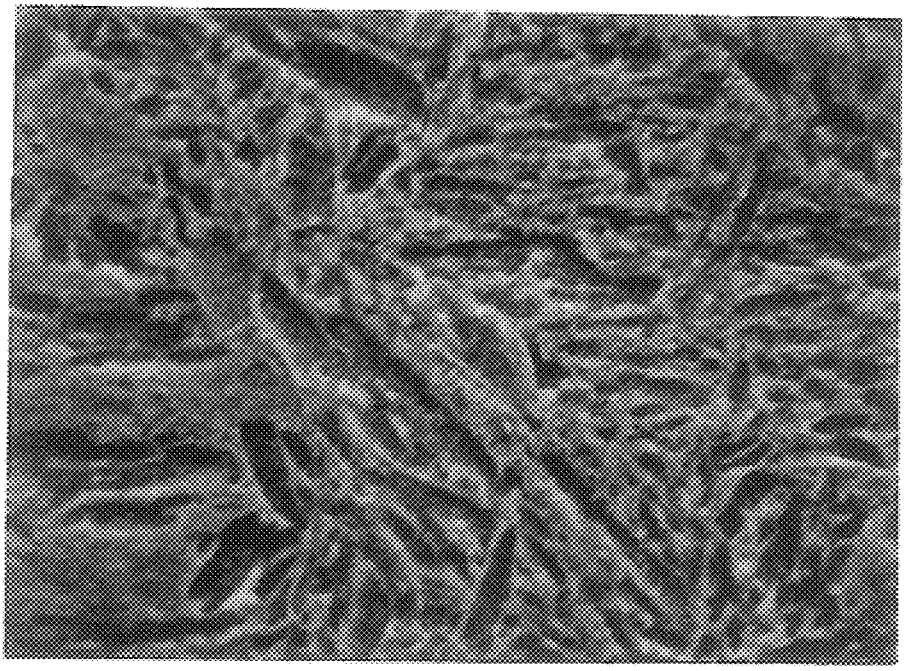
FIG. 6 is a Scanning Electron Microscopy Mag. 5100X photograph of the sample of FIG. 5.

Alternatively, the formed and edged blade may be subjected to an austempeing heat treating process in which the blades are first heated to approximately 1560° F. The heated blades are then quenched into a liquid salt bath at approximately 500° F. for about 20 minutes. The quenched blades are then withdrawn from the salt bath and allowed to air cool to room temperature. This alternative process eliminates the need for further tempering. Scanning electron micrographs of blade material treated according to this process is shown in FIGS. 5 and 6. The material illustrated is AISI 10B38 treated to a Rockwell Hardness of 50 C. The Charpy V-Notch toughness of the sampled material is 18 ft-lbs.

The micrographs were obtained by cross-sectioning the blade material with an abrasive cut-off saw, then mounting the material in a conductive medium. The cut face is polished with a 0.3 micron polishing compound, and the surface is then etched in 2 percent Nital etchant. This etching erodes away the softer material and lets the harder material, primarily iron carbide particles, stand up above the surface.

Figure 4:
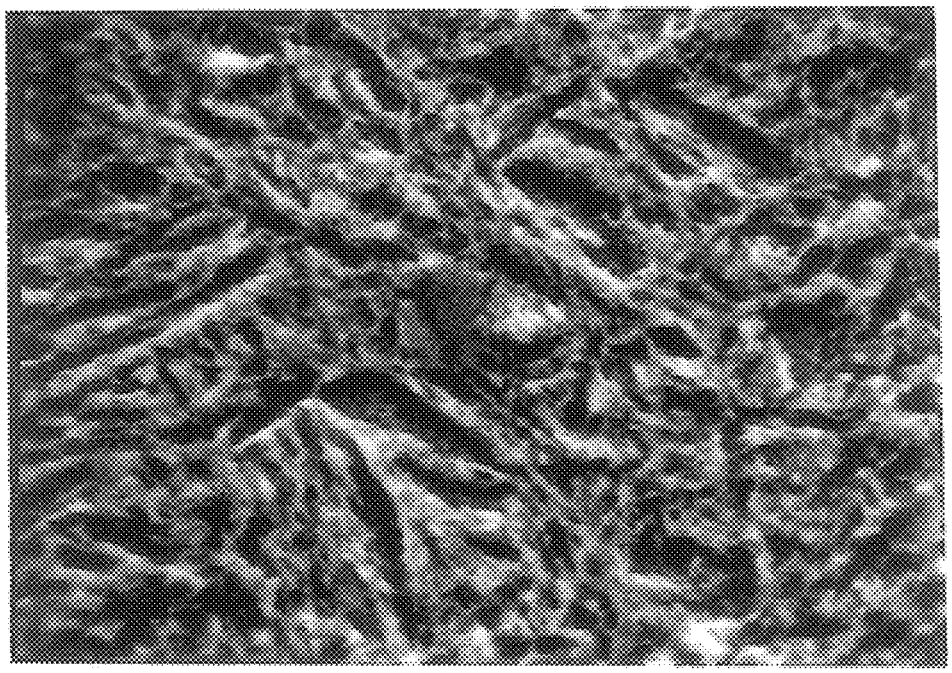
FIG. 4 is a Scanning Electron Microscopy Mag. 5100X photograph of the sample of FIG. 3.

For comparison purposes, a prior art blade material has been prepared and photomicrographed as shown in FIGS. 4 and 5. The material is AISI 9255, with a hardness of 46 Rockwell C, and a Charpy V-notch toughness of 12 ft-lbs. The prior art blade material is of a type commonly used in Europe, and is used in imported disc mower blades.

The ratio of volume of iron carbide to volume of ferrite is lower in the 10B38 of this invention, than in the prior art AISI 9255 sample. However, there does not appear to be a significant difference in the morphology of the iron carbide particles. The greater volume of ferrite in the material of the present invention is believed to provide a structure with high toughness.

A higher carbon content material will tend to have higher volume of iron carbide. However, increased carbon content will typically result in a loss of material toughness, depending on how the iron carbide is distributed in the structure.

The effect of this heat treating process is to elevate the hardness of the boron steel. There is of necessity a decline in the material toughness. However, because of the iron carbide distribution and morphology of the medium carbon steel, the heat-treated steel still retains acceptable levels of toughness, while also being provided with superior hardness.

The blade 20 of this invention is thus tough enough to survive impact, while at the same time is hard enough to offer extended wear life.

It should be noted that although a disc mower blade has been disclosed, other rotary cutting blades may also be formed according to this invention, for example rotary lawn mower blades, flail blades, double edged blades, star blades, and other anvil-less rotary cutting arrangement blades may also be formed. Furthermore, although the Marquenching heat treatment process has been disclosed, other conventional heat treatment processes may be used to increase the hardness of the boron steel blade into the range of 48 to 55 Rockwell C.

Although yielding a somewhat lesser toughness, a functional blade may be achieved by heat treating the formed blank in a conventional quench and temper process, involving quenching in oil, polymer or water, followed by tempering at approximately 300° F.

For example, a 10B38 blank heat treated with a water quench was determined to have a Rockwell Hardness of 50 RC and a Charpy notch test toughness of about 15 ft-lbs.

It is understood that the invention is not limited to the particular construction and arrangement of parts herein illustrated and described, but embraces such modified forms thereof as come within the scope of the following claims.

I claim:

1. A rotary cutting blade comprising a boron steel blank raised through heat treatment to a Rockwell C hardness of between 48 and 55 on the Rockwell Hardness Scale and a toughness of 15 ft. lb. or higher on the Charpy Notched Impact Toughness Test per ASTM E-23.

2. The rotary cutting blade of claim 1 wherein the blank is formed of a boron steel selected from the group consisting of 10B36, 10B37, 10B38, 10B39, 10B40, 10B41 and 10B42 steel.

3. A mower comprising a rotary cutting blade formed of a boron steel blank raised through heat treatment to a Rockwell C hardness of between 48 and 55 on the Rockwell Hardness Scale and a toughness of 15 ft. lb. or higher on the Charpy Notched Impact Toughness Test per ASTM E-23, the blade being rotatably mounted for cutting action.

* * * * *

US005899052C1

(12) EX PARTE REEXAMINATION CERTIFICATE (8104th)

United States Patent
Turner

(10) Number: US 5,899,052 C1
(45) Certificate Issued: Mar. 22, 2011

(54) HIGH HARDNESS BORON STEEL ROTARY BLADE

(75) Inventor: Darrel L. Turner, Reeseville, WI (US)

(73) Assignee: Fisher Barton Blades, Inc., Watertown, WI (US)

Reexamination Request:
No. 90/010,706, Oct. 2, 2009

Reexamination Certificate for:

| | |
|---|---|
| Patent No.: | **5,899,052** |
| Issued: | **May 4, 1999** |
| Appl. No.: | **08/899,198** |
| Filed: | **Jul. 23, 1997** |

Related U.S. Application Data

(62) Division of application No. 08/532,046, filed on Sep. 21, 1995, now Pat. No. 5,916,114.

(51) Int. Cl.
*C21D 9/22* (2006.01)
*C21D 9/18* (2006.01)

(52) U.S. Cl. ..... 56/255; 56/295; 56/DIG. 17; 29/557

(58) Field of Classification Search ..... None
See application file for complete search history.

(56) References Cited

U.S. PATENT DOCUMENTS

| | | | |
|---|---|---|---|
| 1,924,099 | A | 8/1933 | Bain |
| 2,528,867 | A | 11/1950 | Day |
| 2,586,041 | A | 2/1952 | Hodge |
| 3,267,654 | A | 8/1966 | Hanson et al. |
| 4,326,370 | A | 4/1982 | Thorud |
| 5,131,965 | A | 7/1992 | McVicker |

OTHER PUBLICATIONS

G. Krauss, Stells—Heat Treatment and Processing Principles, Principles of Heat Treatment of Steel, Dec. 1989, 4 pages.

American Society for Metals, Metals Hanbook, Ninth Ed., vol. 8, Mechanical Testing, Jun. 1985, 4 pages.

ASM International, Metals Handbook, Tenth Ed., vol. 1, Properties and Selection: Irons, Steels, and High–Performance Alloys, Mar. 1990, 10 pages.

S. S. Babu, G. M. Goodwin R. J. Rohde and B Sielen, Effect of Residual Boron on the Microstructure of Low–Carbon Steel Resistance–Seam Welds, Welding Journal, 1997, 11 pages.

Daniel H. Herring, Boron in Steel, industrialheating.com, May 3, 2007, 4 pages.

American Society for Metals, Atlas of Isothermal Transformation and Cooling Transformation Diagrams, Mar. 1977, 4 pages.

American Society for Metals, Heat Treater's Guide, Standard Practices and Procedures for Steel, Jun. 1982, 3 pages.

H. B. Knowlton, Boron and Other Low Alloy Steels, Society of Automotive Engineers, Inc., SAE Annual Meeting,Jan. 14, 1952, 19 pages.

Keough, John R., et al., "Austempering of Steel," ASM Handbook, Heat Treating, vol. 4, 10th Ed., Aug. 1991.

Patton, W.G., "Austempered Lawnmower Blades Are Hard, Tough," Iron Age Article, Jul. 31, 1952.

Roe, C.J. et al, "Notch Toughness of Steels," ASM Handbook, Properties and Selection: Irons, Steels and High–Performance Alloys, vol. 1, 10th Ed., Mar. 1990.

Boyer, Howard E., "Metals Handbook, Desk Edition," American Society for Metals, 1985.

Impact Toughness (Charpy Impact) printed from http:www.umist.ac.uk/MatSci/research/intmic/features/charpy/notes.htm, on Jan. 29, 2002.

ANSI/ASAE S483 NOV98 Rotary mower Blade Ductility Test, Nov. 1998.

*Primary Examiner*—Stephen J Stein

(57) ABSTRACT

A rotary blade for a mower or cutter is formed from boron steel, such as 10B38 steel, and is heat treated to yield high hardnesses of 48 Rockwell C or above. The blade has increased hardness because of the heat treating, but due to the alloy composition, is still sufficiently tough to perform satisfactorily as a cutting blade, in particular to pass conventional impact tests. Furthermore, the low carbon content of the blade makes cold working of the part practical.

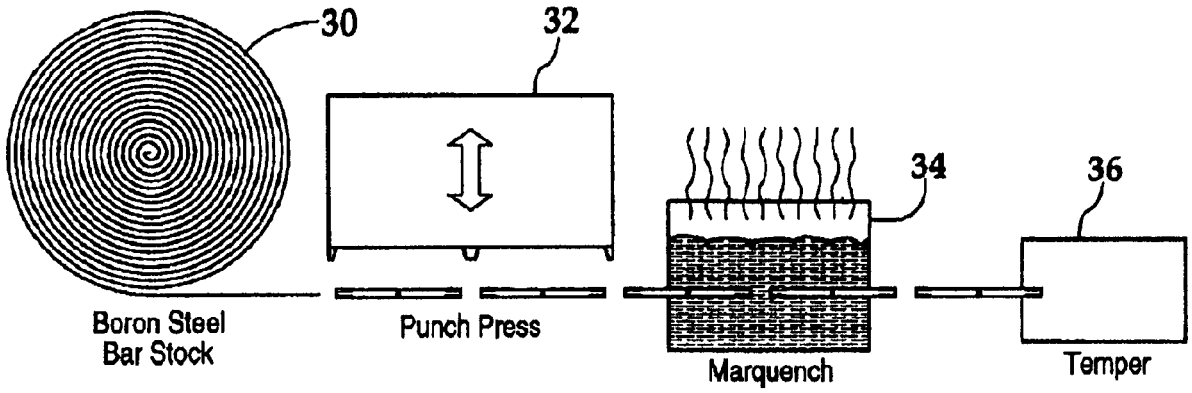

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-3 is confirmed.

* * * * *